US007232324B2

(12) United States Patent
Oesterhaus

(10) Patent No.: US 7,232,324 B2
(45) Date of Patent: Jun. 19, 2007

(54) ELECTRICAL CONNECTOR BRIDGE ARRANGEMENT WITH RELEASE MEANS

(75) Inventor: Jens Oesterhaus, Detmold (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 77 days.

(21) Appl. No.: 11/281,821

(22) Filed: Nov. 17, 2005

(65) Prior Publication Data

US 2007/0082551 A1 Apr. 12, 2007

(30) Foreign Application Priority Data

Dec. 4, 2004 (DE) ..... 20 2004 018 757

(51) Int. Cl.
*H01R 11/22* (2006.01)

(52) U.S. Cl. ..... 439/268; 439/441; 439/511

(58) Field of Classification Search ..... 439/507–511, 439/439–441, 268
See application file for complete search history.

(56) References Cited

U.S. PATENT DOCUMENTS 3,345,603 A * 10/1967 Cohen ..... 439/268
3,431,536 A * 3/1969 Olson ..... 439/268
4,978,315 A * 12/1990 Edgley et al. ..... 439/441
6,244,904 B1 * 6/2001 Fabian et al. ..... 439/656
6,250,950 B1 * 6/2001 Pallai ..... 439/441
7,182,631 B2 * 2/2007 Kollmann ..... 439/511
2006/0266196 A1 * 11/2006 Hanning et al. ..... 84/313

* cited by examiner

*Primary Examiner*—Neil Abrams
(74) *Attorney, Agent, or Firm*—Lawrence E. Laubscher, Sr.; Lawrence E. Laubscher, Jr.

(57) ABSTRACT

A plug-in electrical bridge connector includes a pair of parallel bridge contacts that extend through contact openings contained in an insulated bus bar housing arrangement for electrical engagement with bus bars mounted in chambers contained therein, respectively. A locking device is arranged in at least one of the bus bar chambers for automatic locking engagement with the associated bridge contact, thereby to retain the bridge contact in engagement with the associated bus bar. A release device is moveably mounted on the bridge connector body for displacement from a retracted position toward an operable extended position in which the release member unlocks the locking device from the bridge contact, thereby to permit removal of the bridge connector from the bus bar housing arrangement.

12 Claims, 3 Drawing Sheets

ELECTRICAL CONNECTOR BRIDGE ARRANGEMENT WITH RELEASE MEANS

BACKGROUND OF THE INVENTION

1. Field of the Invention

A bridge connector connects includes a pair of parallel bridge contacts that extend through contact openings contained in a pair of insulated housings for electrical engagement with bus bars mounted therein, respectively. A locking device is arranged in at least one of the housing chambers for automatic locking engagement with the associated bridge contact, thereby to retain the bridge contact in the housing chamber in engagement with the associated bus bar. A release member is mounted on the bridge member for displacement from a retracted position toward an operable extended position in which the release member unlocks the locking device from the bridge contact, thereby to permit removal of the bridge connector from the housings.

2. Description of the Related Art

It is well known in the prior art to connect a pair of bus bars contained in housings by a bridge connector having a pair of bridge contacts in engagement with the bus bars, respectively, which bridge contacts are joined by a transverse connecting portion. The housings are formed of electrical insulating material and may include electrical devices, such as panel boxes, power distribution circuits, and the like.

Generally, the contacts of the bridge connector are parallel and extend through contact openings contained in the housings for engagement with the bus bars contained therein, respectively. In order to securely retain the bridge contacts in the housing chambers in engagement with the bus bars, it has been proposed to provide automatic one-way locking devices in the form of leaf springs, for example, which leaf springs have leg portions that terminate in edges that dig into the outer periphery of the bridge contacts, whereby it is impossible to withdraw the contacts from the housing without destroying the bridge contact assembly. Thus, the direct plug-in technique of the known devices does not require any tool for assembling the bridge connector in a permanent manner. However, owing to the manner in which the leaf springs dig into the bridge contacts, the leaf springs must be disengaged from the bridge contacts by a release tool, such as a screwdriver or the like, thereby to permit removal of the bridge contact from the housing chamber in which the bus bar is mounted.

Naturally, such a disassembly procedure is difficult, awkward and inefficient. Furthermore, since the bridge contacts are relatively long and generally have the same length, the locking means for the two legs of the bridge connector must be disengaged simultaneously, so that the bridge connector may be removed in a steady, even manner. This simultaneous unlocking procedure presents a major problem for disassembly of the contacts, thereby further increasing the cost and difficulty of removing the bridge connector from the bus bar housings.

To solve this problem, it is proposed by the present invention to provide on the bridge connector body a permanently mounted release member that is displaceable from an inoperable retracted position toward an operable extended position in which it releases the locking member from the associated bridge contact.

BRIEF SUMMARY OF THE INVENTION

Accordingly, a primary object of the present invention is to provide a plug-in bridge connector for connecting a pair of bus bars by a plug-in bridge connector having bridge contacts that are automatically locked in the bus bar housings, together with release means mounted on the bridge connector body for displacement from an inoperable retracted position toward an operable extended position, thereby to release the locking means from the bridge contact, whereby the bridge connector may be removed from the bus bar housings.

According to a more specific object of the invention, the bridge connector includes a bridge body containing a conductor having a pair of bridge contacts that extend from one side of the bridge body into the bus bar housing chambers via contact openings for engagement with the bus bars mounted therein, respectively. The release means moveably mounted on the bridge body include a release member having a pair of rigid release leg portions that extend through release openings contained in the housings for disengaging the automatic locking means associated with the bridge contacts, respectively. In the preferred embodiment, the locking means comprise one-way leaf springs that automatically dig into the bridge contacts to retain the same within the bus bar chambers, respectively. The release means include a pair of rigid release legs that engage leg portions of the leaf springs to disengage the same from the associated bridge contacts, respectively.

The present invention makes it possible to automatically effect simultaneous locked bridging contact with the bus bars without the requirement of any separate disconnecting tool, such as a screwdriver. Since the disconnect member is carried by and permanently retained on the bridge body, the disconnect device will not become separated from the bridge body and inadvertently lost.

According to another object of the invention, the locking devices comprise inverted U-shaped leaf springs including first leg portions that are fastened to the bus bar chamber walls, and second leg portions that are biased toward engagement with the bridge contacts, respectively. The second leg portions terminate in sharp edges that dig into the outer surfaces of the bridge contacts, thereby to retain the same against removal from the bus bar housing chambers. In order to assist in disengaging the second leaf spring leg portions from the bridge contacts, the release members are provided at their ends with inclined ramp surfaces that come into sliding engagement with the leaf spring second leg portions.

According to a further object of the invention, the release means include stop means that prevent removal of the release means from the bridge connector body.

BRIEF DESCRIPTION OF THE DRAWINGS

Other objects and advantages of the invention will become apparent from a study of the following specification when viewed in the light of the accompanying drawings, in which.

DETAILED DESCRIPTION OF THE INVENTION

Figure 1:
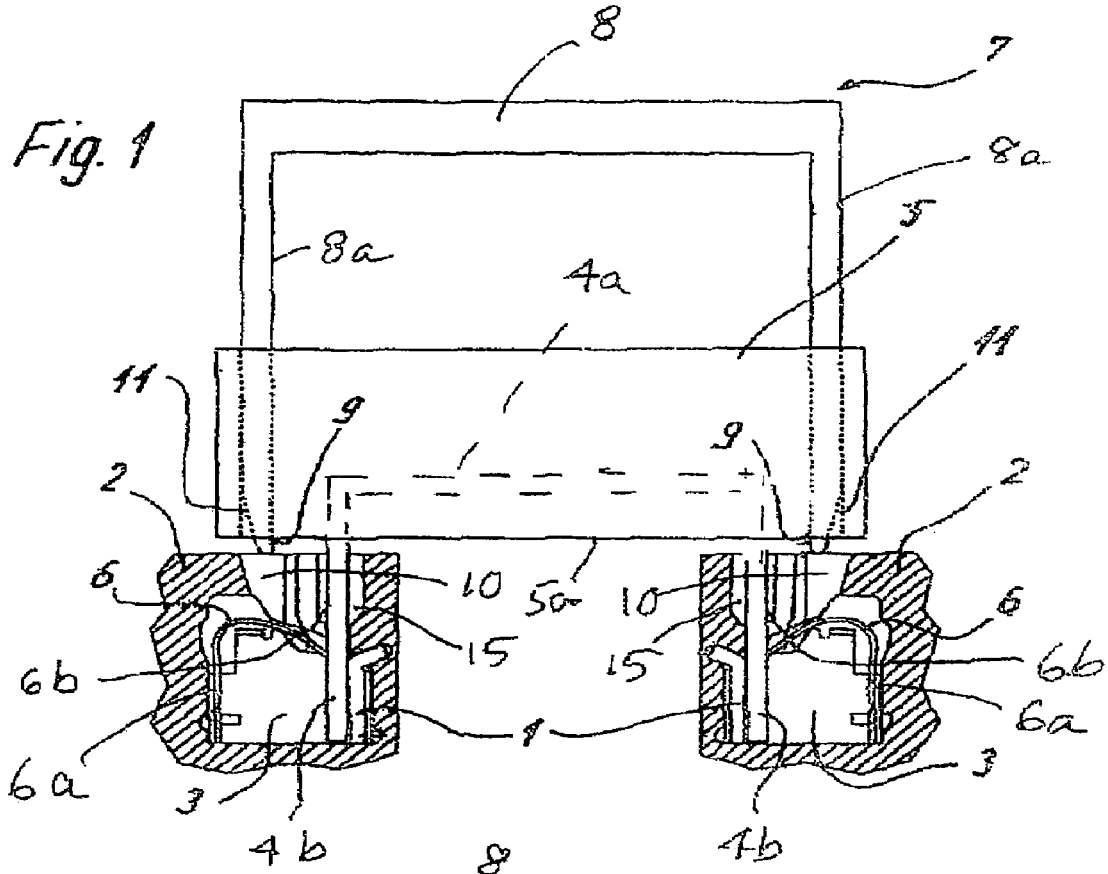
FIG. 1 is a partly sectioned side elevation view illustrating the bridge connector in its fully inserted and locked position, and with the release means in its initial retracted position.

Referring first more particularly to FIG. 1, the bridge type connector assembly includes a pair of bus bar housings 2 containing chambers 3 in which are mounted the bus bars 1. The bridge connector means includes a bridge body 5 in which is mounted the bridge conductor 4 having a transverse portion 4*a* embedded in the insulating material of the bridge body 5, and a pair of parallel bridge contacts 4*b* that extend from one side 5*a* of the bridge body into the bus bar chambers 3 via contact openings 15 for engagement with the bus bars 1, respectively. As is known in the art, the bridge contacts 4*a* are automatically locked in the bus bar chambers 3 by leaf spring means 6. Each leaf spring 6 has an inverted U-shaped configuration including a first spring leg 6*a* that is secured to the wall of the bus bar chamber 3, and a second leg portion 6*b* that extends across the chamber 3 opposite the contact opening 15. Thus, when the plug-in bridge connector 5 is in its fully inserted position shown in FIG. 1, the second leg portion 6*b* of the leaf spring engages the associated bridge contact 4*b*, thereby to bias the same into engagement with the associated bus bar 1. The sharp edge at the extremity of the second leg portion 6*b* digs into the outer surface of the bridge contact 4*b*, thereby to lock the bridge contact within the bus bar chamber 3. Thus, when the plug-in bridge connector 5 is in its fully inserted position of FIG. 1, the bus bars 1 are connected via the bridge contacts 5*b* and the transverse conducting portion 4*a* contained in the insulated bridge body 5.

Figure 2:
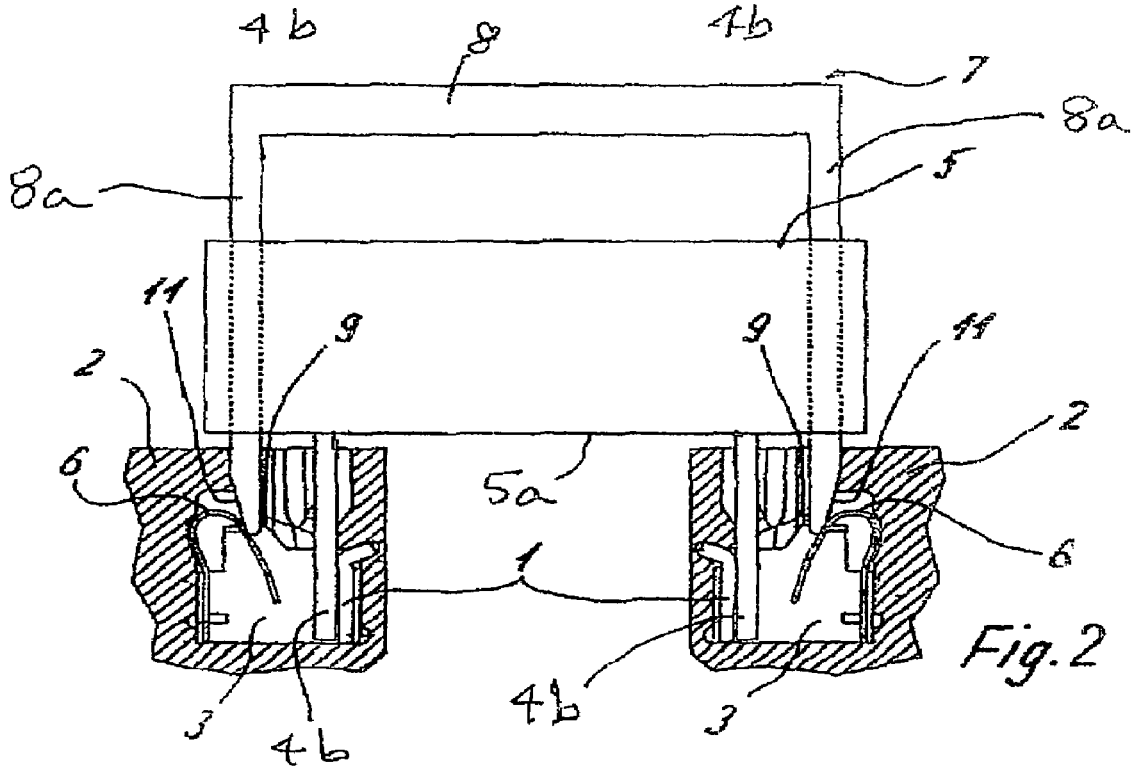
FIG. 2 illustrates the release means in the inserted operable position relative to the bridge connector body, wherein the release means simultaneously release the locking devices from the associated bridge contacts, respectively.

Referring now to FIG. 2, in order to disconnect the leaf spring locking means from the bridge contacts, release means 7 are mounted for sliding displacement relative to the contact bridge body portion 5. More particularly, the release means includes a generally U-shaped release body 8 that is formed of insulating material and includes a pair of parallel rigid leg portions 8*a* that extend through corresponding guide openings contained in the contact bridge body 5. The release leg portions 8*a* are arranged to extend through corresponding release openings 10 contained in the bus bar housings, whereupon the extremities of the release leg portions engage the second arm portion 6*b* of each leaf spring 6, as shown in FIG. 2. As the release body 8 is shifted relative to the connector bridge body 5 from the retracted position of FIG. 1 toward the operable position of FIG. 2, inclined ramp surfaces 11 on the rigid release leg portions 8*a* slidably engage the adjacent surfaces of the leaf spring second portions 6*b*, thereby to disengage the same from the adjacent bridge contacts 4*b*, respectively.

Figure 3:
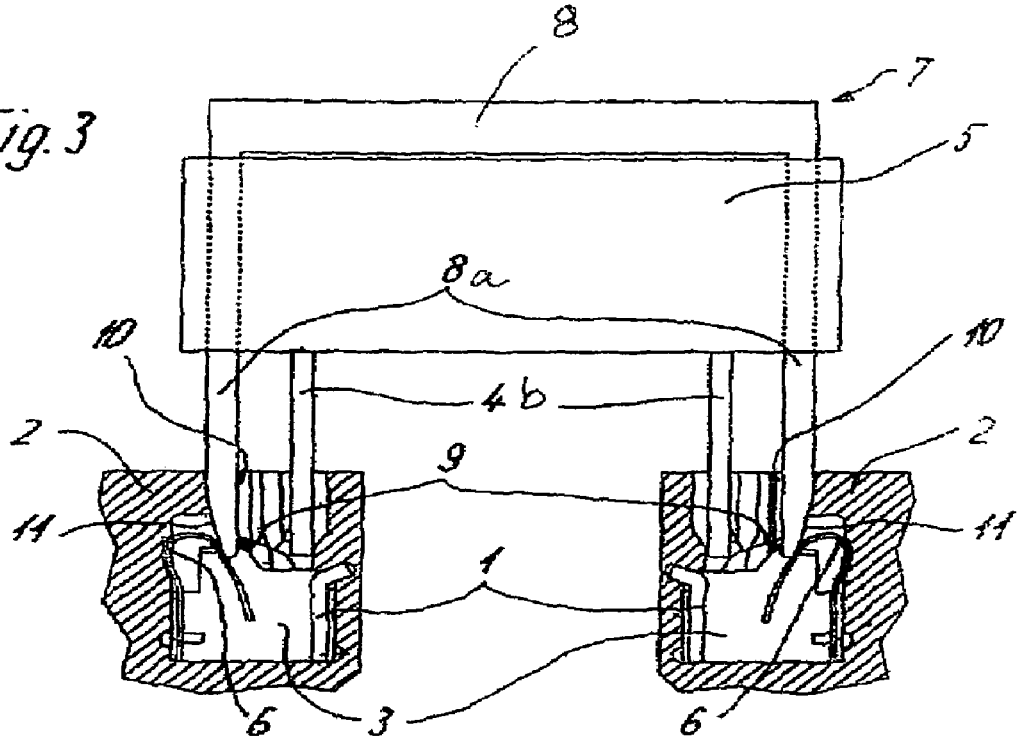
FIG. 3 illustrated the displacement of the bridge connector body relative to the release means to disconnect the bridge contacts from the bus bars, respectively.

Referring now to FIG. 3, when the bridge body 5 is displaced away from the bus bar housings 2 relative to the release member 8, the bridge contacts 4*b* are removed from engagement with the bus bars 1 in the bus bar chambers 3. The bridge body and release member assembly may then be removed from the bus bar housings as shown in FIG. 4, whereupon the second leaf spring leg portion 6*b* extend across both the contact openings 15 and the release openings 10 contained in the bus bar 2.

Figure 5:
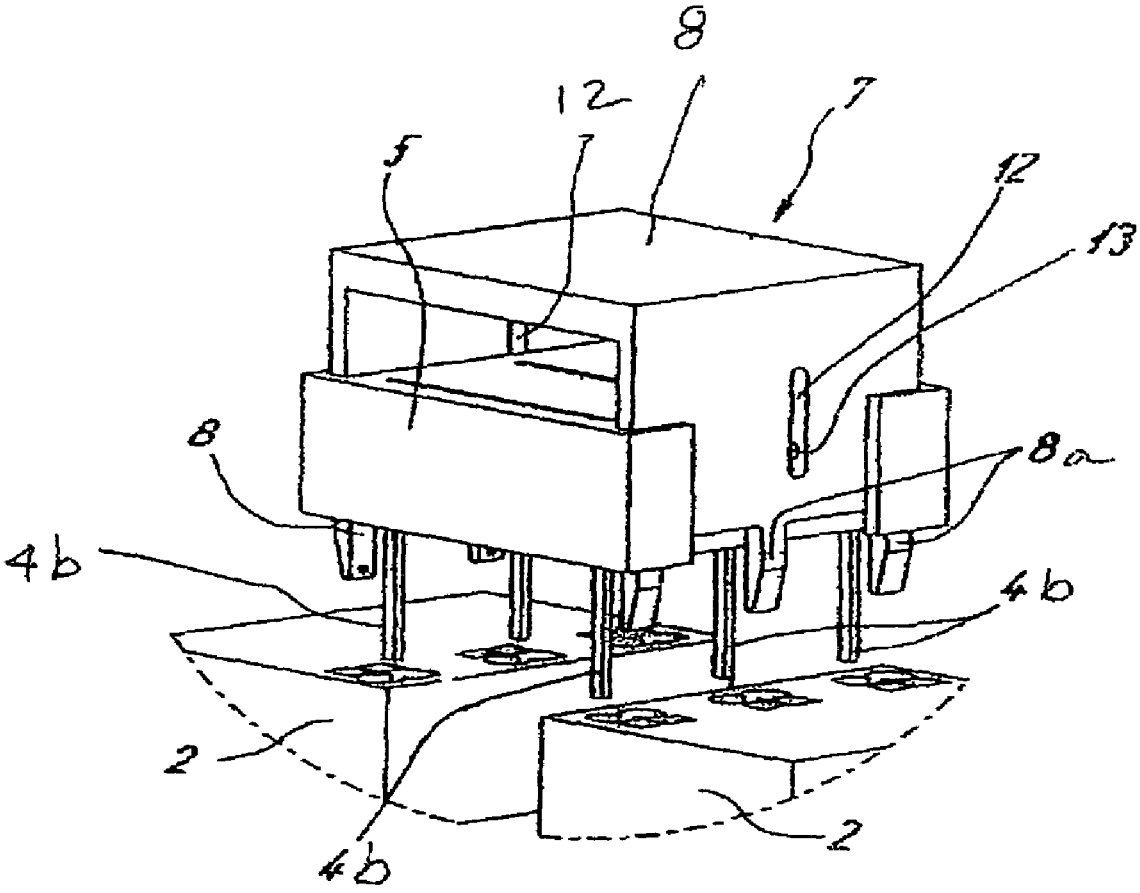
FIG. 5 is a perspective view illustrating the guide means for guiding the release member relative to the bridge connector body.

Referring now to FIG. 5, in order to guide the movement of the release means 7 relative to the bridge connector body 5, vertical guide slots 12 are provided in the opposed side portions 8*a* of the release member 8, thereby to receive guide pins 13 that are provided on the corresponding end walls of the bridge connector body 5. Thus, the release body 8 is guided for displacement relative to the bridge connector body 5, thereby to insure uniform movement of the bridge contacts 4*b* and the release members 8*a* relative to the bus bar housings 2. In this embodiment, a plurality of release members 8*a* and a plurality of bridge contacts 4*b* are provided on the bridge connector for connecting various bus bars mounted within the housings 2.

Figure 4:
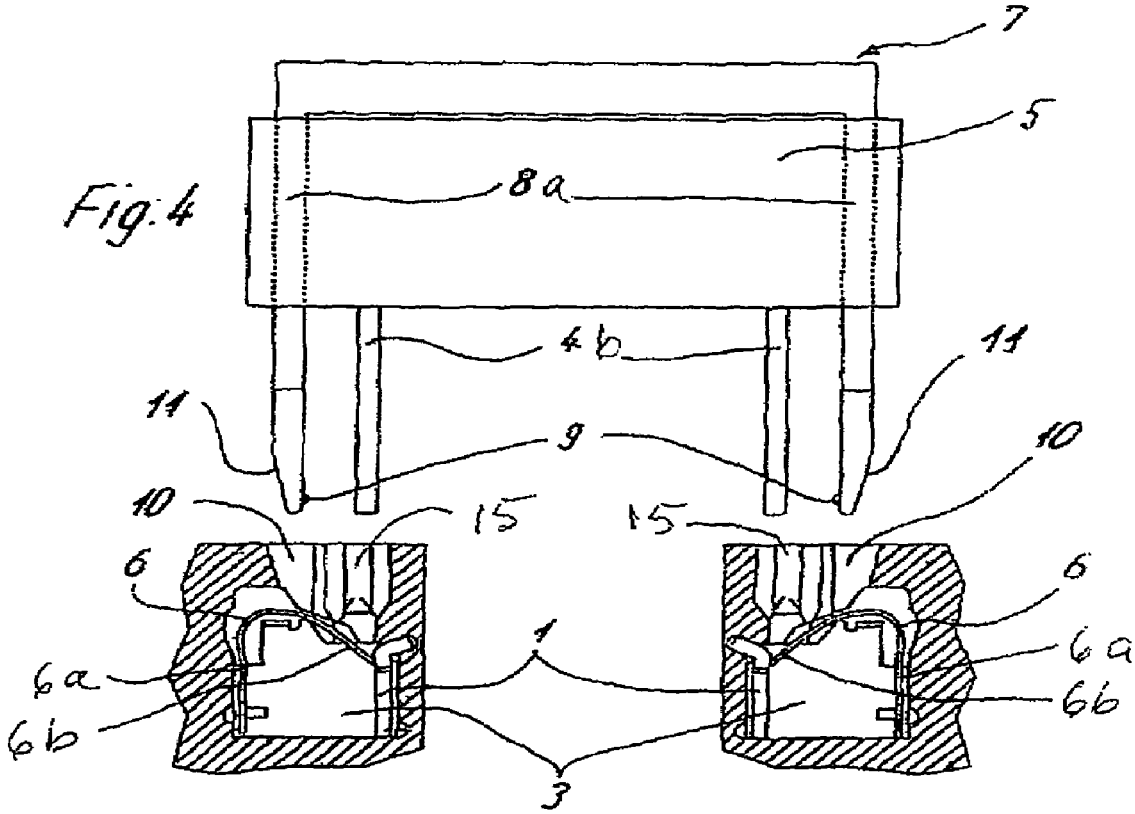
FIG. 4 illustrates the bridge connector and release member assembly in the fully removed condition relative to the bus bar housings.

As shown in FIGS. 1 and 4, stop members 9 are provided at the ends of the release members 8*a*, on the opposite sides thereof from the inclined ramp surfaces 11, which stop surfaces 9 are operable to engage the bridge connector body first surface 5*a*, thereby to prevent removal of the release member 8 from the bridge connector body 5. Thus, the release means are permanently fastened to the bridge connector, thereby to prevent the inadvertent loss thereof. Furthermore, owing to the provision of the guide means 12, 13, simultaneous movement of the release arms relative to the bridge contacts is achieved.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. A bridge connector for electrically connecting a pair of bus bars, comprising:

(a) bus bar housing means (2) containing a pair of chambers (3);

(b) a pair of parallel bus bars (1) mounted in said housing chambers, respectively, said housing means containing corresponding contact openings (15) communicating with said chambers opposite said bus bars, respectively;

(c) bridge means for electrically connecting said bus bars, said bridge means including:

(1) a bridge body (5) formed of insulating material; and (2) a bridge conductor (4) including a first conducting portion (4*a*) contained in said bridge body, and a pair of parallel bridge contacts (4*b*) connected with said connecting portion and extending outwardly from one side of said bridge body, said bridge contacts extending through said contact openings into engagement with said bus bars, respectively;

(d) locking means (6) for locking at least one of said bridge contacts within its associated chamber; and (e) release means (7) carried by said bridge body for releasing said locking means, thereby to permit removal of said bridge contacts from said housing chambers, and disconnection of said bus bars from each other.

2. A bridge connector as defined in claim 1, wherein said release means includes a release member (8) that is mounted on said bridge body for displacement between inoperable retracted and operable extended positions relative to said bridge body; and further including retaining means (9) for preventing removal of said release member from said bridge body.

3. A bridge connector as defined in claim 2, wherein said locking means includes a generally U-shaped leaf spring (6) having a first leg portion (6*a*) connected with one wall of the associated bus bar chamber, and a second leg portion (6*b*) normally biased toward locking engagement with the associated bridge contact; and further wherein said release member includes a rigid leg portion (8*a*) that extends at one end through a release opening (10) contained in said buds bar housing opposite said leaf spring second leg, said release leg portion being operable when said release member is displaced to its operable position to disengage said spring second leg portion from the associated bridge contact.

4. A bridge connector as defined in claim 3, wherein a pair of said leaf springs are provided for locking both of said bridge contacts in their respective housing chambers, and further wherein said release member includes a pair of said release leg portions that extend through corresponding release openings contained in said bus bar housing means for simultaneously engaging said leaf spring second leg portions to unlock the same from the associated bridge contacts, respectively.

5. A bridge connector as defined in claim 4, wherein the extremity of each of said release leg portions includes an inclined ramp surface (11) arranged to slidably engage the associated spring second leg portion as said release member is displaced toward said operable position, thereby to disengage said spring second leg portion from said bridge contact.

6. A bridge connector as defined in claim 5, wherein said retaining means includes a stop (9) carried by at least one of said release leg portions for engagement with said bridge body one side, thereby to prevent removal of said release member from said bridge body.

7. A bridge connector as defined in claim 6, wherein said stop is arranged on said release leg portion on the opposite side thereof from said inclined ramp surface.

8. A bridge connector as defined in claim 2, and further including guide slot and pin means (12, 13) guiding said release member for linear displacement relative to said bridge body.

9. A bridge connector as defined in claim 2, wherein said bus bar housing means includes a pair of separate housings containing said bus bar chambers, respectively.

10. A bridge connector as defined in claim 3, wherein said leaf spring biases said bridge contact toward lateral parallel engagement with the associated bus bar.

11. A bridge connector as defined in claim 3, wherein the extremity of said spring second leg portion has a sharp edge arranged to dig into the outer peripheral surface of said bridge contact, thereby to prevent withdrawal of said bridge contact from said bus bar chamber.

12. A bridge connector as defined in claim 11, wherein said second spring leg portions extend across both the associated housing contact opening (15) and the release opening (10) when the bridge connector assembly is removed from the bus bar housing means.

* * * * *